US005437068A

United States Patent [19]

Fisher

[11] Patent Number: 5,437,068

[45] Date of Patent: Aug. 1, 1995

[54] BODY-CONFORMING, MULTI-FOLDABLE, INFLATABLE MATTRESS HAVING PHASE-SHIFTED SINUSOIDAL SEALS

[75] Inventor: David R. Fisher, Rancho Palos Verdes, Calif.

[73] Assignee: Intex Recreation Corp., Long Beach, Calif.

[21] Appl. No.: 923,224

[22] Filed: Jul. 31, 1992

Related U.S. Application Data

[63] Continuation-in-part of Ser. No. 896,469, Jun. 10, 1992, abandoned.

[51] Int. Cl.[6] ..... A47C 27/08

[52] U.S. Cl. ..... 5/449; 5/458; 5/420; 5/656

[58] Field of Search ..... 5/449, 453, 455, 456, 5/457, 458, 413, 420, 656, 932; 441/129

[56] References Cited

U.S. PATENT DOCUMENTS

| | | | |
|---|---|---|---|
| D. 314,804 | 2/1991 | Thomas | D21/237 |
| D. 314,805 | 2/1991 | Thomas | D21/237 |
| D. 315,774 | 3/1991 | Thomas | D21/237 |
| 585,834 | 7/1897 | Ruth . | |
| 2,772,193 | 11/1956 | Ono | 5/449 |
| 2,788,533 | 4/1957 | Bornstein | 5/420 |
| 2,842,783 | 7/1958 | Druck . | |
| 2,843,181 | 7/1958 | Paschen | 5/449 |
| 3,089,153 | 5/1963 | Bosc . | |
| 3,563,837 | 2/1971 | Smith et al. . | |
| 3,688,775 | 9/1972 | Rayman | 128/366 |
| 3,701,173 | 10/1972 | Whitney | 5/453 |
| 4,097,944 | 7/1978 | Yulish . | |
| 4,547,919 | 10/1985 | Wang . | |
| 4,756,032 | 7/1988 | Wang | 4/506 |
| 4,891,855 | 6/1990 | Cheng-Chung | 5/449 |
| 4,946,183 | 10/1990 | LaForce, Jr. . | |
| 5,101,823 | 4/1992 | Smith | 128/369 |

FOREIGN PATENT DOCUMENTS

| | | | |
|---|---|---|---|
| 807010 | 6/1951 | Germany | 5/457 |
| 2197192 | 5/1988 | United Kingdom | 5/453 |

OTHER PUBLICATIONS

Pending U.S. patent application, Ser. No. 07/923,224 filed on Jul. 31, 1992, (CIP) of pending application having Ser. No. 07/896,469 filed on Jun. 30, 1992, see p. 2, lines 16 to 33.

*Primary Examiner*—Flemming Saether
*Attorney, Agent, or Firm*—David N. Makous; John S. Christopher

[57] ABSTRACT

An inflatable air mattress having a generally rectangular mat portion that is foldable or bendable in multiple directions in a fully inflated condition. The mat portion includes rows of generally sinusoidal seals extending transversely across the mat portion. Alternating rows of the sinusoidal seals are uniformly shifted out of phase by a range of about $\frac{1}{8}$ to $\frac{3}{8}$ of the repeating period, or a phase shift of from about $\pi/4$ radians to about $3\pi/4$ radians, and most preferably by a phase shift of about $\pi/2$ radians. Alternating rows of inflation chambers are formed by the sinusoidal seals with enlarged body portions and neck portions of reduced thickness, which form natural fold lines in the mat portion when the mat portion is inflated. The mat portion is bendable longitudinally, transversely and obliquely to be rollable and foldable, and to permit the mat portion to cradle the torso and extremities of a person reclining on the inflatable mattress in water.

11 Claims, 3 Drawing Sheets

BODY-CONFORMING, MULTI-FOLDABLE, INFLATABLE MATTRESS HAVING PHASE-SHIFTED SINUSOIDAL SEALS

RELATED APPLICATIONS

This is a continuation-in-part of Ser. No. 07/896,469 filed Jun. 10, 1992 now abandoned.

BACKGROUND OF THE INVENTION

1. Field of the Invention

This invention relates generally to an inflatable apparatus for use as a float in water or as a cushion on a firm surface, and more particularly concerns an inflatable air mattress having a mat portion that is bendable in an inflated condition particularly along transverse and oblique lines between portions of reduced thickness, allowing the mat portion to be rolled up or folded in an inflated condition and allowing the mat portion to cradle a person reclining on the inflatable mattress in water.

2. Description of Related Art

Inflatable air mattresses, cushions, and the like of the type having a typically rectangular main body portion with longitudinal or tubular air chambers are well known in the art. One drawback of such inflatable devices is that in a fully inflatable condition they can be generally unwieldy to carry, and are usually quite rigid. When such an inflatable air mattress is used as a flotation mattress in water, a person resting on the flotation mattress can typically also slide or roll off of the flotation mattress when the person's weight is not well centered on the flotation mattress, making it sometimes difficult for the person to board the flotation mattress when it is in water.

It would therefore be desirable to provide such an inflatable flotation mattress that is foldable or bendable in at least one direction to allow the mattress to be folded or rolled in a fully inflated condition, for easy carrying, transportation or storage. It would also be desirable to provide such an inflatable flotation mattress that is foldable or bendable in more than one direction to allow the mattress to cradle the body of a person resting on the mattress by becoming indented or depressed by the weight of the person in a configuration that conforms to the body weight of the person.

One conventional inflatable flotation mattress providing bend or fold lines allows the mattress to be rolled about a pillow portion in a fully inflated condition. That flotation mattress design includes a rectangular inflatable mat portion with side-by-side dual sets of symmetrically arranged diamond shaped air chambers, formed by alternating transverse sinusoidal heat seal lines shifted by half of the repeating sine wave pattern. The transverse heat seal lines allow the mat portion to be rolled. The heat seal lines also form a pattern of intersecting folding lines allowing the mat portion to conform to the body of a person floating on the mat in water. It has been found, however, that full inflation of the air chambers tends to pull opposite sides of the mat portion together, causing distorting wrinkles in the air chambers. It is also known that oblique orientation of air chambers can cause the mat portion to be slanted to one side or the other when fully inflated.

It is therefore desirable to provide for an inflatable mattress that can be used as a flotation mattress, that is foldable, bendable, or rollable in multiple directions to allow the mattress to be rolled or folded when fully inflated, and to sufficiently cradle the parts of the body of a person resting on the mattress, and to support the person without distorting the shape of the mat portion of the mattress, and without causing the mat portion to be slanted to one side, when fully inflated. The present invention meets these needs.

SUMMARY OF THE INVENTION

Briefly, and in general terms, the present invention provides for an inflatable mattress that can be rolled or folded in a fully inflated condition, and that can bend in multiple directions to conformingly cradle the body of a person resting on the mattress. The configuration of the mat portion of the inflatable mattress is an improvement over the prior art in allowing the mat portion to bend along orthogonal and oblique lines in a fully inflated condition, without distorting the shape of the mat.

The invention accordingly provides for an improved inflatable air mattress formed from two or more layers of flexible sheet material sealed together to form an inflatable pillow portion and an inflatable, generally rectangular mat portion that is foldable or bendable in more than one direction in a fully inflated condition. The mat portion includes rows of alternating, generally sinusoidal seals extending transversely across the mat portion, bonding the two layers of flexible sheet material. The rows of alternating seals include a first plurality of seals, and a second plurality of seals spaced apart from the first plurality of generally sinusoidal seals, with the first and second plurality of generally sinusoidal seals each formed to include the shape of a plurality of sine waves with a repeating period. The second plurality of generally sinusoidal seals is preferably uniformly phase shifted with respect to the first plurality of generally sinusoidal seals by a range of about $\frac{1}{8}$ to $\frac{3}{8}$0 of the repeating period. Where the repeating period is defined as being $2\pi$, radians the uniform phase shift is from about $\pi/4$ radians to about $3\pi/4$ radians with respect to the first plurality of generally sinusoidal seals. In one preferred embodiment, the first and second pluralities of rows of seals are uniformly shifted out of phase by about $\frac{1}{4}$ of the repeating period, or by a phase shift of about $\pi/2$ radians. The alternating rows of generally sinusoidal seals preferably form a plurality of alternating rows of inflation chambers having enlarged body portions and narrower neck portions adjacent to the seals. When fully inflated, the neck portions have a reduced thickness in comparison to that of the enlarged body portions, to form natural fold lines in the mat portion with adjacent portions of the sinusoidal seals. The enlarged body portions in the alternating rows of inflation chambers are generally oriented in symmetrically opposing and intersecting oblique or diagonal directions, so that the mat portion is bendable longitudinally, transversely and obliquely to be rollable and foldable, and permit the mat portion to cradle the torso and extremities of a person resting on the inflatable mattress in water.

These and other aspects and advantages of the invention will become apparent from the following detailed description, and the accompanying drawing, which illustrates by way of example the features of the invention.

DETAILED DESCRIPTION OF A PREFERRED EMBODIMENT

Figure 1:
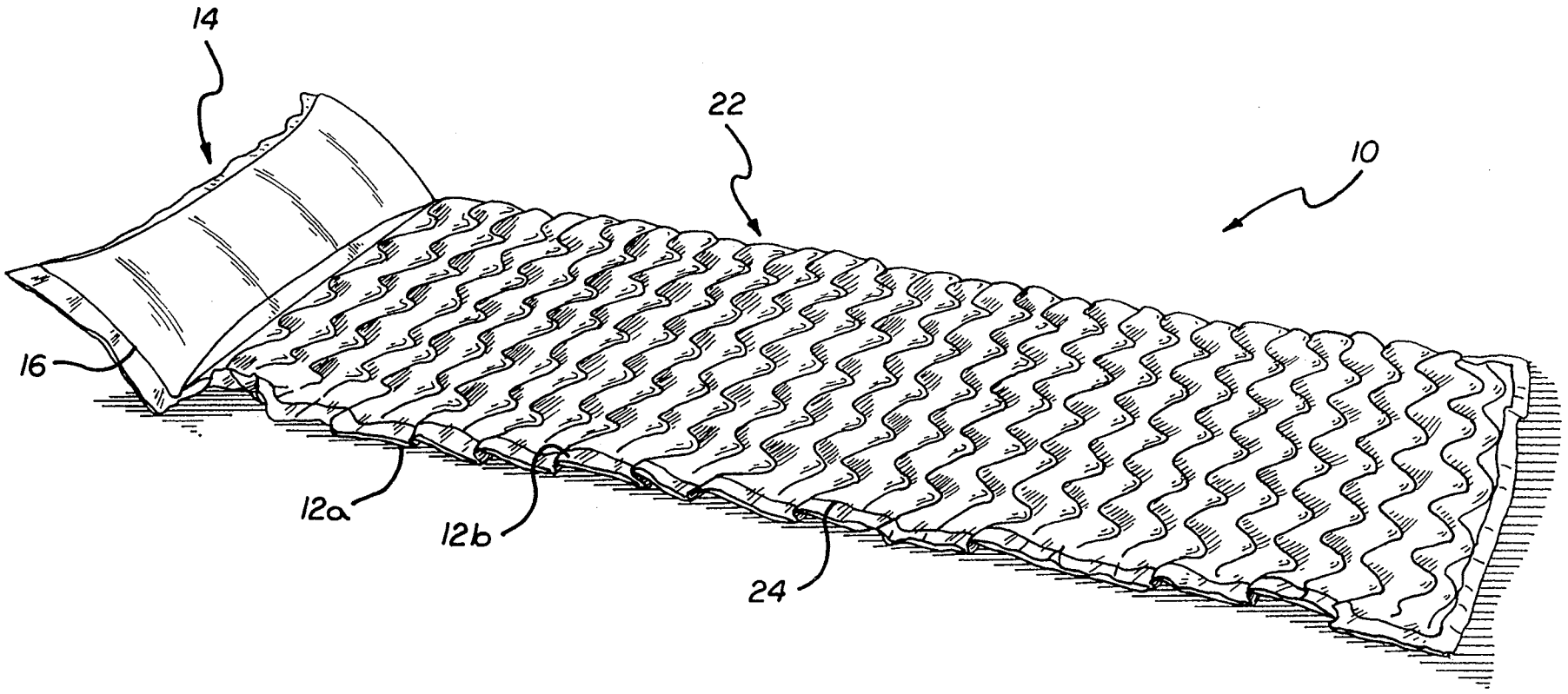
FIG. 1 is a perspective view of the inflatable mattress of the invention in a fully inflated condition.

Inflatable air mattresses of the type often used as water flotation mattresses can be generally unwieldy to carry in a fully inflated condition. They are usually designed to be generally quite firm and rigid in a fully inflated condition, so that a person resting on the flotation mattress can often easily tip over or fall off of the flotation mattress in water when the person's weight is not well centered. Full inflation can also distort the entire shape or portions of the air mattress, as expansion of air chambers pulls other areas together.

As is illustrated in the drawings, the invention is embodied in an inflatable mattress that can be rolled or folded in a fully inflated condition, and that can bend and conform to the positioning of a person resting thereon, in multiple directions in a fully inflated condition, without distorting the shape of the mattress.

Figure 2:
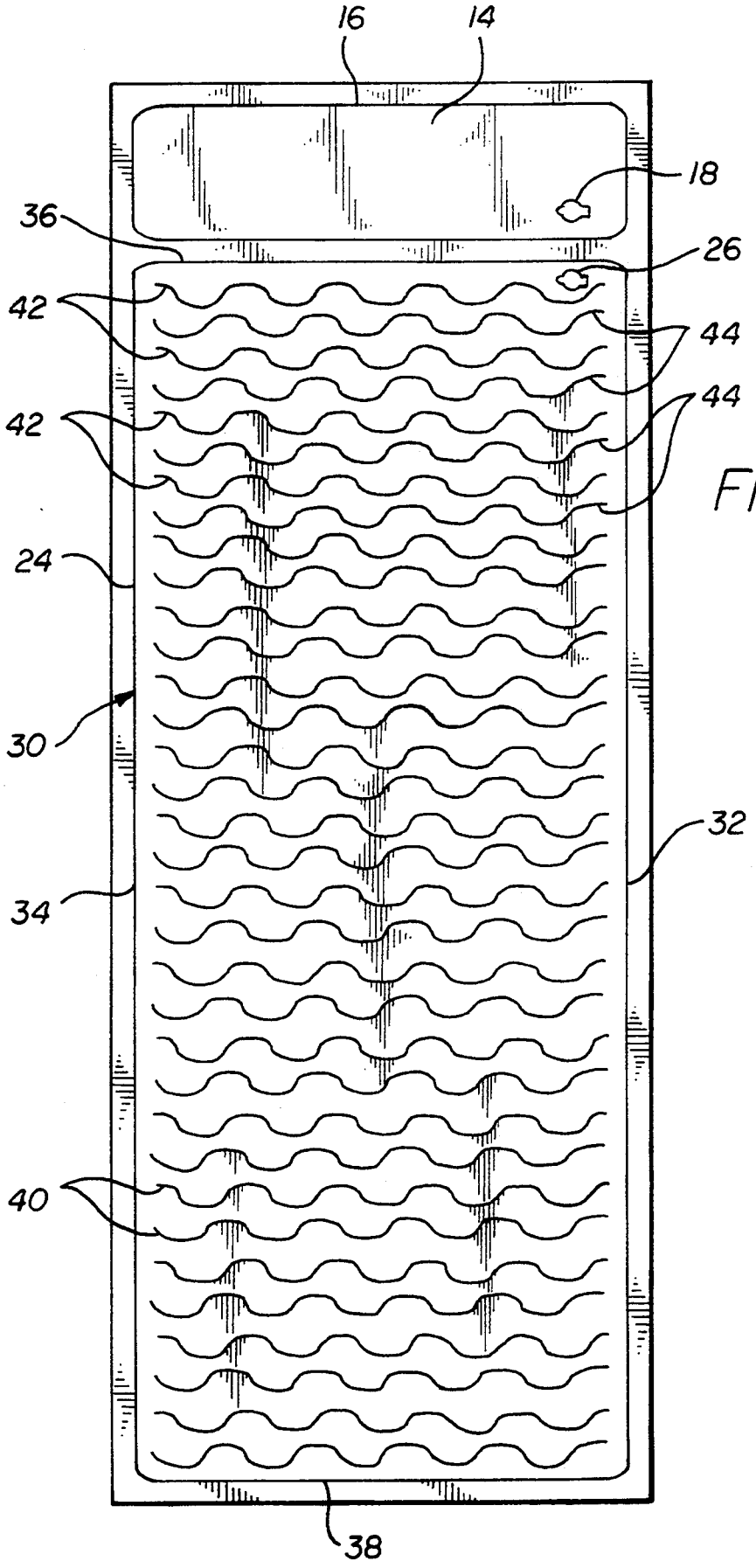
FIG. 2 is a bottom plan view of the inflatable mattress in an uninflated condition.
Figure 4:
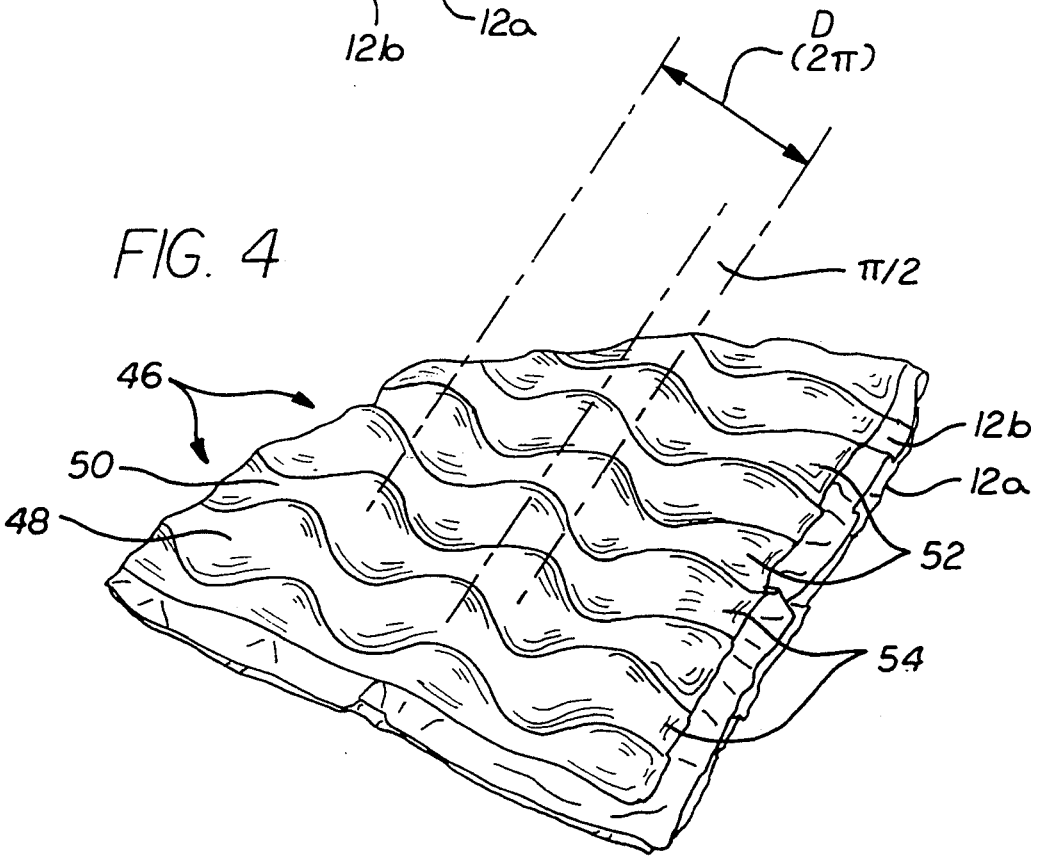
FIG. 4 is an enlarged fragmentary view of a lower corner of the mat portion of the inflatable mattress in a fully inflated condition.

With reference to FIGS. 1, 2 and 4, in a preferred embodiment of the invention, an inflatable flotation mattress 10 is formed from at least two layers 12*a*, 12*b* of flexible thermoplastic sheet material bonded together by heat seals. Additional layers of material, such as protective or reflective layers, may also be incorporated in the inflatable mattress. The thermoplastic sheet material is preferably a vinyl plastic such as polyvinyl chloride, although polyvinyl chloride copolymers, polymers containing the vinyl radical ($CH_2{=}CH{-}$) or the vinylidene radical ($CH_2{=}C<$), nylon, linear polyethylene, polystyrene, polypropylene and the like may also be appropriate. It is also possible that other types of flexible sheet material could be used, such as various types of rubber, and that other types of seals, such as adhesive seals, may also be feasible.

The flotation mattress typically includes an inflatable pillow portion 14 formed by a heat seal 16 around the perimeter of the pillow portion between the two layers of thermoplastic, with an inflation valve 18 for inflating and deflating the pillow portion.

The flotation mattress also includes a mat portion 22 formed by a heat seal 24 around the perimeter of the mat portion between the two layers of thermoplastic, with an inflation valve 26 for inflating and deflating the mat portion. The mat portion includes a peripheral edge 30 formed by the heat seal 24, having a first longitudinal side edge 32, a second longitudinal side edge 34, and first and second (upper and lower) transverse edges 36 and 38 extending between the longitudinal side edges. The heat seals are preferably formed by bonding the two layers of thermoplastic sheet by radio frequency induced electronic welding, although heat sealing with a hot bar or other type of heated tool may also be suitable for appropriate thermoplastic sheet materials.

As can best be seen in FIG. 4, the mat portion includes an improved configuration of air chambers designed for folding and bending in multiple directions. Alternating rows 40 of generally sinusoidal heat seals formed between the two layers of plastic sheet material extend transversely across the mat portion from a position spaced apart from one longitudinal side edge a short distance to a short distance from the opposing side edge. In a typical inflatable mattress about $7\frac{1}{2}$ feet long overall, about three feet wide, and having a pillow about one foot wide, the ends of the alternating rows are typically spaced apart from the longitudinal sides about one inch. The rows of alternating seals include a first plurality of seals 42, and a second plurality of seals 44 spaced apart from the first plurality of generally sinusoidal seals, with the first and second plurality of generally sinusoidal seals each formed to have a shape including a plurality of sine waves 46 having a repeating period D, or $2\pi$radians. In a typical inflatable mattress according to the invention, the period D is about 6 inches long, the amplitude of the sine shaped seals is about 1.5 inches, and the sine shaped seals are spaced apart about one inch. The second plurality of generally sinusoidal seals is preferably uniformly shifted out of phase with respect to the first plurality of sinusoidal seals by a range of about $\frac{1}{8}$ to $\frac{3}{8}$ of the repeating period D, or in other words, by a uniform phase shift of from about $\pi/4$ radians to about $3\pi/4$ radians with respect to the first plurality of generally sinusoidal seals. In the currently most preferred embodiment, the first and second pluralities of rows of seals are uniformly phase shifted by about $\frac{1}{4}$ of the repeating period, or by a phase shift of about $\pi/2$ radians. The alternating rows of generally sinusoidal seals form a plurality of alternating rows of inflation chambers, which have enlarged body portions 48 and narrowed neck portions 50 of relatively reduced thickness compared to the thickness of the enlarged body portions when the mat portion is inflated. The reduced thickness of the neck portions and adjacent portions of the sinusoidal seals form natural fold lines in the mat portion when the mat portion is in an inflated condition.

Figure 3:
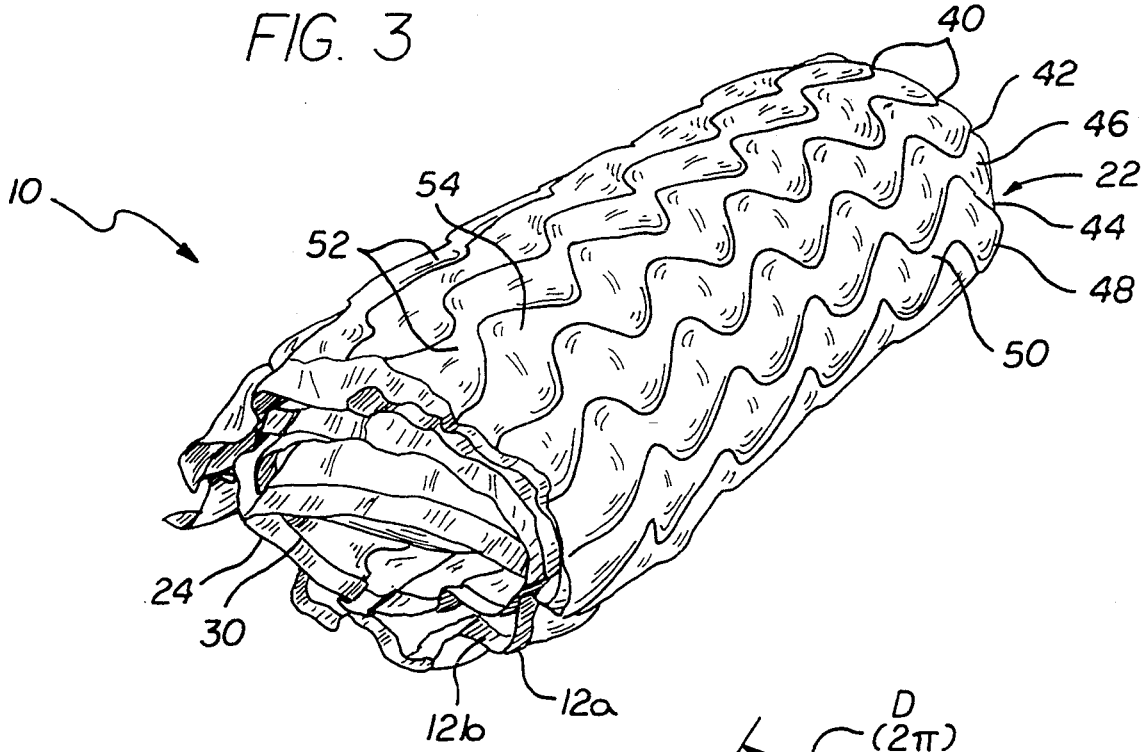
FIG. 3 is a perspective view of the inflatable mattress of the invention rolled up in a fully inflated condition.

The alternating rows of inflation chambers include a first plurality 52 of inflation chambers and a second plurality 54 of inflation chambers formed between the rows of sinusoidal seals 40. The enlarged body portions of the inflation chambers are preferably oriented obliquely with respect to the orthogonal longitudinal and transversed edges of the mat portion, with adjacent rows of the enlarged body portions oriented along intersecting oblique, or diagonal, lines. In the preferred embodiment in which the alternate rows of sinusoidal seals are uniformly shifted out of phase by about $\frac{1}{4}$ of the repeating period or a phase shift of about $\pi/2$ radians, the orientation of the enlarged body portions of the first plurality 52 of inflation chambers is approximately at right angles to the orientation of the enlarged body portions 48 of the second plurality 54 of inflation chambers. The enlarged body portions in the alternating rows of inflation chambers are thus generally oriented in symmetrically opposing and diagonal or oblique directions oblique to the edges of the mat portion, so that when the mat portion is fully inflated, the forces causing dimensional shrinking of the narrowed neck portions and of the overall dimensions of the mat portion caused by expansion of the inflation chambers is substantially balanced by the expansion of adjacent inflation chambers lying in a different orientation. The natural folding and bending lines formed by the areas of reduced thickness of the neck portions and the heat seals permit the mat portion to be bendable longitudinally, transversely and diagonally so that the mat portion can be rolled or folded either on itself or around the pillow portion as is shown in FIG. 3. The natural folding and bending lines also permit the mat portion to cradle the portions of the body of a person reclining on the inflatable mattress 10 in water.

It will be apparent from the foregoing that while a particular form of the invention has been illustrated and described, various modifications can be made without departing from the spirit and scope of the invention. Accordingly, it is not intended that the invention be limited, except as by the appended claims.

What is claimed is:

1. An inflatable air mattress comprising:

an inflatable mat portion formed by sealing together an edge of each of two layers of flexible sheet material;

a first plurality of generally sinusoidal seals for bonding the two layers of flexible sheet material together, said first plurality of generally sinusoidal seals extending transversely across the mat portion; and a second plurality of generally sinusoidal seals for bonding the two layers of flexible sheet material together, said second plurality of generally sinusoidal seals being spaced apart from said first plurality of generally sinusoidal seals and extending transversely across the mat portion interspersed between and alternating with said first plurality of generally sinusoidal seals, said first and second plurality of generally sinusoidal seals each formed to include the shape of a plurality of sine waves having a repeating period of $2\pi$ radians, and said second plurality of generally sinusoidal seals being uniformly phase shifted by from about $\pi/4$ radians to about $3\pi/4$ radians with respect to the first plurality of generally sinusoidal seals, said sine waves of said first and second plurality of generally sinusoidal seals form a plurality of alternating rows of first and second non-tortuous continuous, transverse inflation chambers, said first and second non-tortuous continuous transverse inflation chambers each having a plurality of enlarged body portions and a plurality of narrowed neck portions interconnecting said enlarged body portions wherein each enlarged body portion in the alternating rows of non-tortuous continuous, transverse inflation chambers is sinusoidal-shaped and oriented in symmetrically opposing directions to the enlarged body portions in adjacent rows so as to balance the expansion of said non-tortuous continuous transverse inflation chambers having different orientations to prevent distortion of said mat portion when inflated, and each narrowed neck portion and said first and second plurality of generally sinusoidal seals form folding lines to enable said mat portion to be bendable longitudinally, transversely and diagonally when inflated for folding and rolling and for cradling a body reclining thereon in water.

2. The inflatable air mattress of claim 1, wherein said first and second pluralities of generally sinusoidal seals are shifted out of phase with respect to each other by a phase shift of about $\pi/2$ radians.

3. The inflatable air mattress of claim 1, wherein said flexible sheet material comprises a thermoplastic material selected from the group consisting of vinyl plastic, polyvinyl chloride, polyvinyl chloride copolymers, polymers containing the vinyl radical or the vinylidene radical, nylon, linear polyethylene, polystyrene, and polypropylene.

4. The inflatable air mattress of claim 1 further including means for inflating and deflating said mat portion.

5. The inflatable air mattress of claim 4 wherein said means for inflating and deflating said mat portion comprises a valve.

6. The inflatable air mattress of claim 1 wherein said inflatable mat portion is formed by creating a heat seal around a perimeter of said inflatable air mattress.

7. The inflatable air mattress of claim 1 further including an inflatable pillow portion formed between said two layers of flexible sheet material.

8. The inflatable air mattress of claim 7 wherein said inflatable pillow portion is formed by creating a heat seal around a perimeter at one end of said inflatable air mattress and a transverse edge shared with said inflatable mat portion.

9. The inflatable air mattress of claim 7 further including means for inflating and deflating said pillow portion.

10. The inflatable air mattress of claim 9 wherein said means for inflating and deflating said pillow portion comprises a valve.

11. The inflatable air mattress of claim 1 wherein said folding lines formed in said inflatable mat portion permit folding and rolling the mat portion about a pillow portion when said mat portion and said pillow portion are each inflated.

* * * * *